US005848823A

United States Patent [19]

Su

[11] Patent Number: 5,848,823

[45] Date of Patent: Dec. 15, 1998

[54] CHAIR ARMREST ADJUSTER

[76] Inventor: Wen-Fa Su, No. 1-2, Hsia Chuang Tzu, Ko Li Village, Tung Shan Hsiang, Tainan Hsien, Taiwan

[21] Appl. No.: 30,548

[22] Filed: Feb. 26, 1998

[51] Int. Cl.[6] ..... A47K 7/54

[52] U.S. Cl. ..... 297/411.36; 297/411.35; 297/411.37

[58] Field of Search ..... 297/411.36, 411.35, 297/411.37, 411.38, 411.27, 411.26

[56] References Cited

U.S. PATENT DOCUMENTS 5,484,187 1/1996 Doerner et al. ..... 297/411.36
5,597,208 1/1997 Bonutti ..... 297/411.35
5,647,638 7/1997 Ritt et al. ..... 297/411.36
5,655,814 8/1997 Gibbs ..... 297/411.35

*Primary Examiner*—Peter M. Cuomo
*Assistant Examiner*—Anthony D. Barfield
*Attorney, Agent, or Firm*—Rosenberg, Klein & Bilker

[57] ABSTRACT

A chair armrest adjuster includes a vertical adjuster and an angle adjuster combined with a seat and an armrest cushion. The vertical adjuster is fixed with the seat with a fix plate, able to be lifted and lowered down elastically to one of many positions and locked. The angle adjuster is combined on the vertical adjuster and swung inward or outward to one of many angles with a rotatable base. Thus the armrest is able to be adjusted in its height and angle so as to support and give comfortableness to the arms of a user who sits on a chair.

5 Claims, 4 Drawing Sheets

CHAIR ARMREST ADJUSTER

BACKGROUND OF THE INVENTION

This invention relates to a chair armrest adjuster, particularly to one able to be adjusted in its height and its angle inward and outward.

As technology has greatly developed, automation and computerization has become current tide, and workers in offices perform their work by means of computers, sitting almost all day on a chair, using their hands for a long time with chair armrests supporting their arms.

However, conventional chair armrests are immovable to have an unadjustable height and angle, having the following disadvantages.

1. As their height is unadjustable to correspond to the height of a user, the arms of the user may be easily tired with no supports after a long period of use.
2. A user must have his/her arms unsupported in operating a computer because of chair armrests being unadjustable, he/she would have sour shoulders, fatigue, and bad work efficiency after a long period of work.

SUMMARY OF THE INVENTION

The purpose of the invention is to offer a kind of chair armrest adjuster, which can adjust an armrest of a chair in its height by means of elasticity of a coil spring and locked in an adjusted position, and also in its angle by means of a rotatable base. Thus, the height and the angle of a chair armrest cushion may be adjusted according to the height of a user, his/her habit, and work need, supporting the arms of the user to decrease fatigue in working, especially with a computer.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
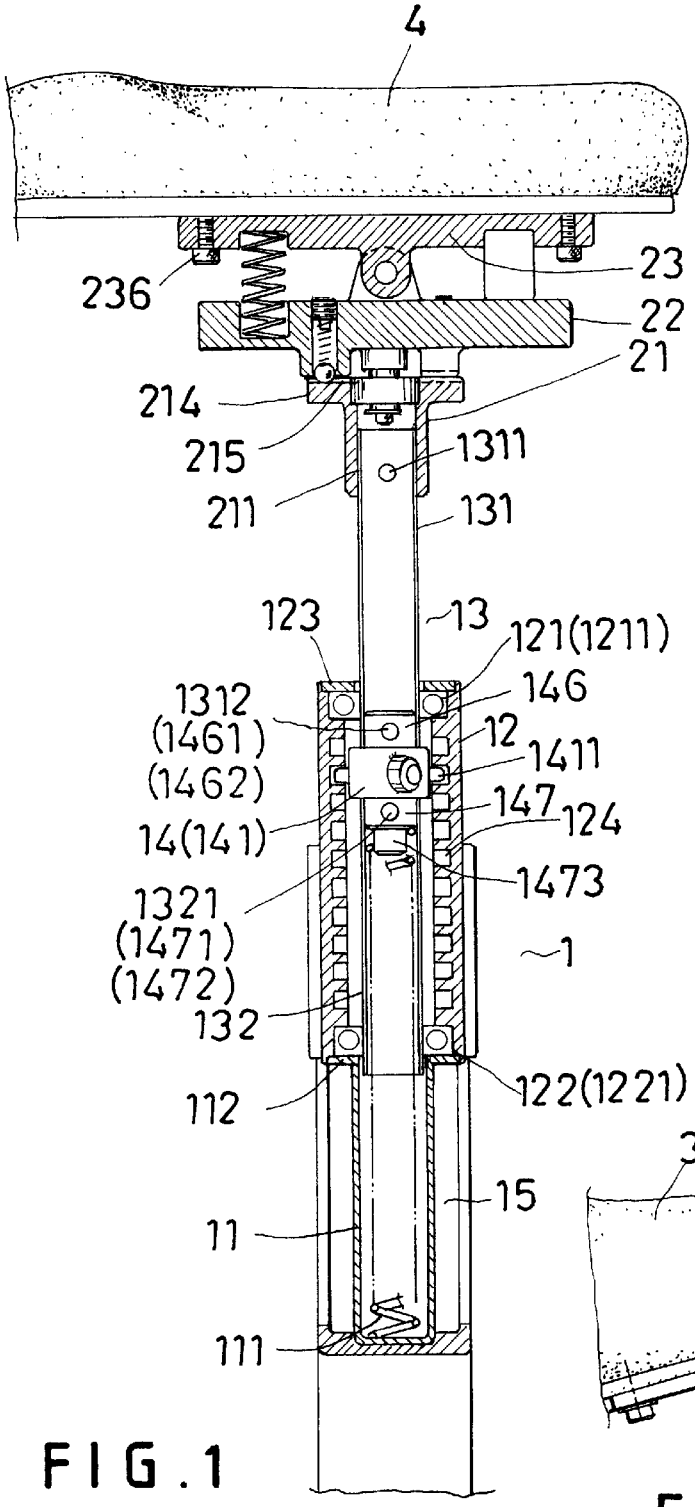
FIG. 1 is a side cross-sectional view of a chair armrest adjuster of the present invention.
Figure 2:
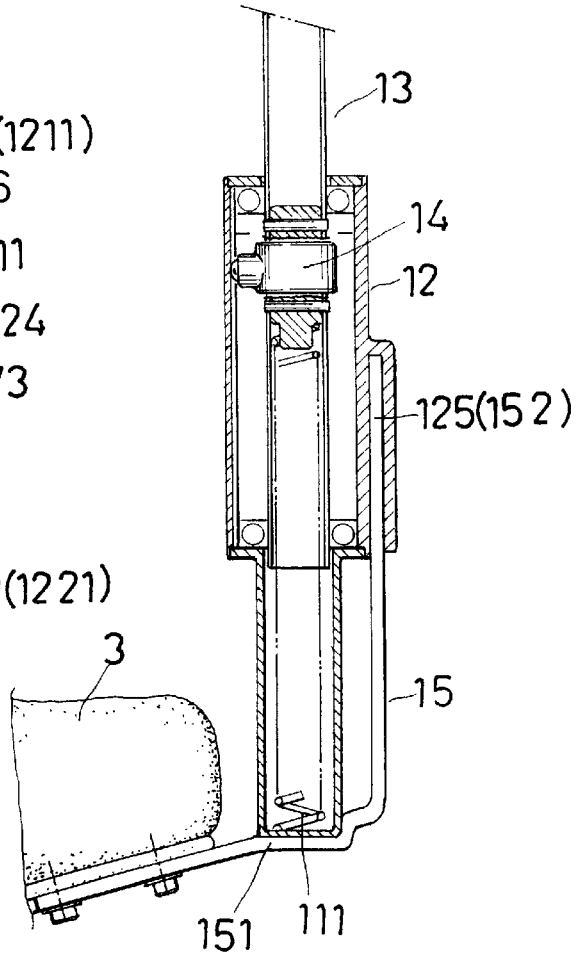
FIG. 2 is a partial side cross-sectional view of a chair armrest adjuster of the present invention.

A preferred embodiment of a chair armrest adjuster in the present invention, as shown in FIGS. 1, and 2, includes a vertical adjuster 1 and an angle adjuster 2 combined with a seat 3 and an armrest cushion 4 of a chair.

The vertical adjuster 1 consists of a sleeve tube 11, a locking tube 12, a support tube 13, a locking means 14 and a fix plate 15.

The sleeve tube 11 has its bottom closed, a coil spring 111 of a proper length fitted in a hollow interior, and a stop plate 112 provided on an upper end to fixed with the locking tube 12.

The locking tube 12 has a recess 121, 122 respectively formed in an upper and a lower end for a linear bearing 1211, 1221 to fit therein, an upper cap 123 closing on an upper mouth, a plurality of opposite engage grooves 124 formed in an inner wall spaced apart equidistantly, a short stop wall 1241 provided beside each engage groove 124. In addition, a long inserting groove 125 is formed on an outer surface of the locking tube 12 for And a pair of opposite vertical guide slots 126 (a first) and 127 (a second) are formed respectively just between the two lines of the engage grooves 124.

The support tube 13 consists of an upper and a lower tube portions 131 and 132 combined with a locking means 14. The upper tube portion 131 has a through lateral hole 1311, 1312 respectively formed in an upper and a lower end, extending up through the cap 123. The lower tube portion 132 fits in the coil spring 111 contained in the sleeve tube 11, movable in the sleeve tube 11 and having a through lateral hole 1321 in an upper end.

Figure 3:
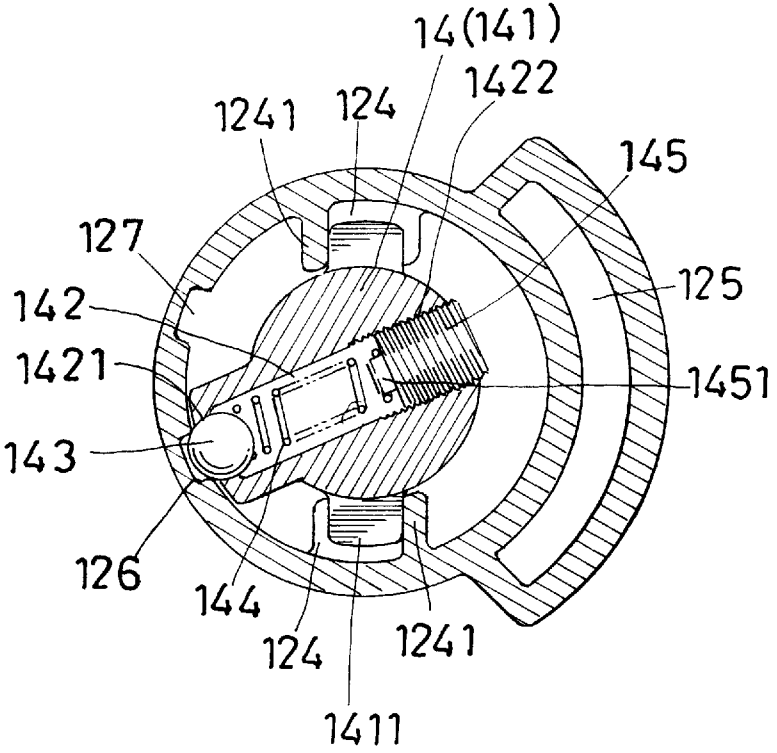
FIG. 3 is a cross-sectional view of a vertical adjuster in the chair armrest adjuster of the present invention.

The locking means 14, as shown in FIG. 3, has its body 141 and a locking stud 1411 respectively provided on two end surfaces to engage a pair of the opposite engage grooves 124 of the locking tube 12. Further, the body 141 also has a through hole 142 formed with a small diameter hole portion 1421 and a threads portion 1422 connected with the hole portion 1421, and a steel bead 143, a coil spring 144 and a headless screw 145 are orderly fitted in the through hole 142, with the headless screw 145 engaging the threads 1422 and with the steel bead 143 and the coil spring 144 located in the hole portion 1421. Then the coil spring 144 has one end pushing the steel bead 143 and the other end resting around a stud 1451 of the screw 145, with tightness of the steel bead 143 adjustable by screwing in and out the headless screw 145. Further, an upper and a lower connecter 146 and 147 are provided to be connected with the body 141, and the upper and the lower connecter 146 and 147 have respectively a pin hole 1461 and 1471, connected fittingly with the upper and the lower tube 131 and 132 respectively, with pins 1462, 1472 fitting in the through holes 1312, 1321 of the upper and the lower tube 131, 132 and further in the pin holes 1461, 1471 of the upper and the lower connecter 146 and 147 so that the upper tube and the lower tube 131 and 132 are respectively connected with the upper and the lower connecter 146, 147. Further, the lower connecter 147 has a downward round stud 1473 for securing the coil spring 111.

The fix plate 15 has a lower flat portion 151 for the bottom of the sleeve tube 11 to rest thereon, and an extending sidewise portion from the flat portion 151 combined with a lower side of a seat 3, and a vertical portion 152 extending up from the flat portion 151 and inserting tightly in the insert groove 125 formed on an outer surface of the locking tube 12, having the same shape as the insert groove 125.

Figure 5:
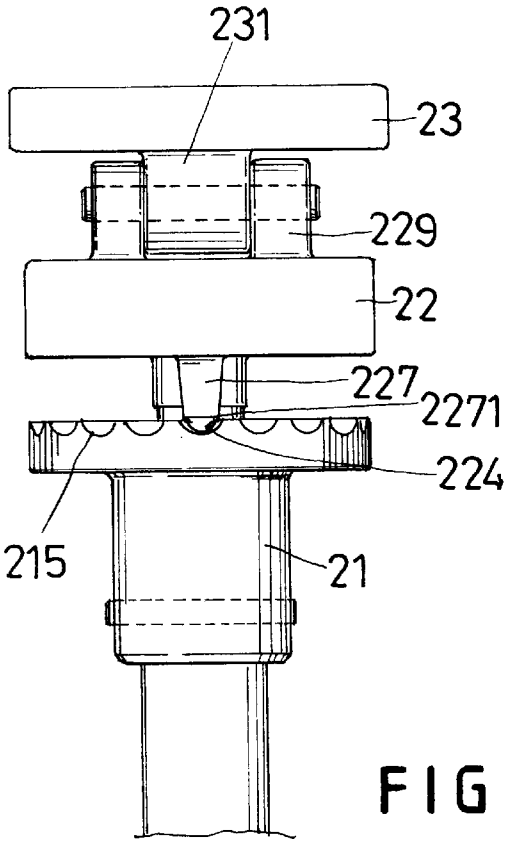
FIG. 5 is a front view of the angle adjuster of the chair armrest adjuster of the present invention.
Figure 4:
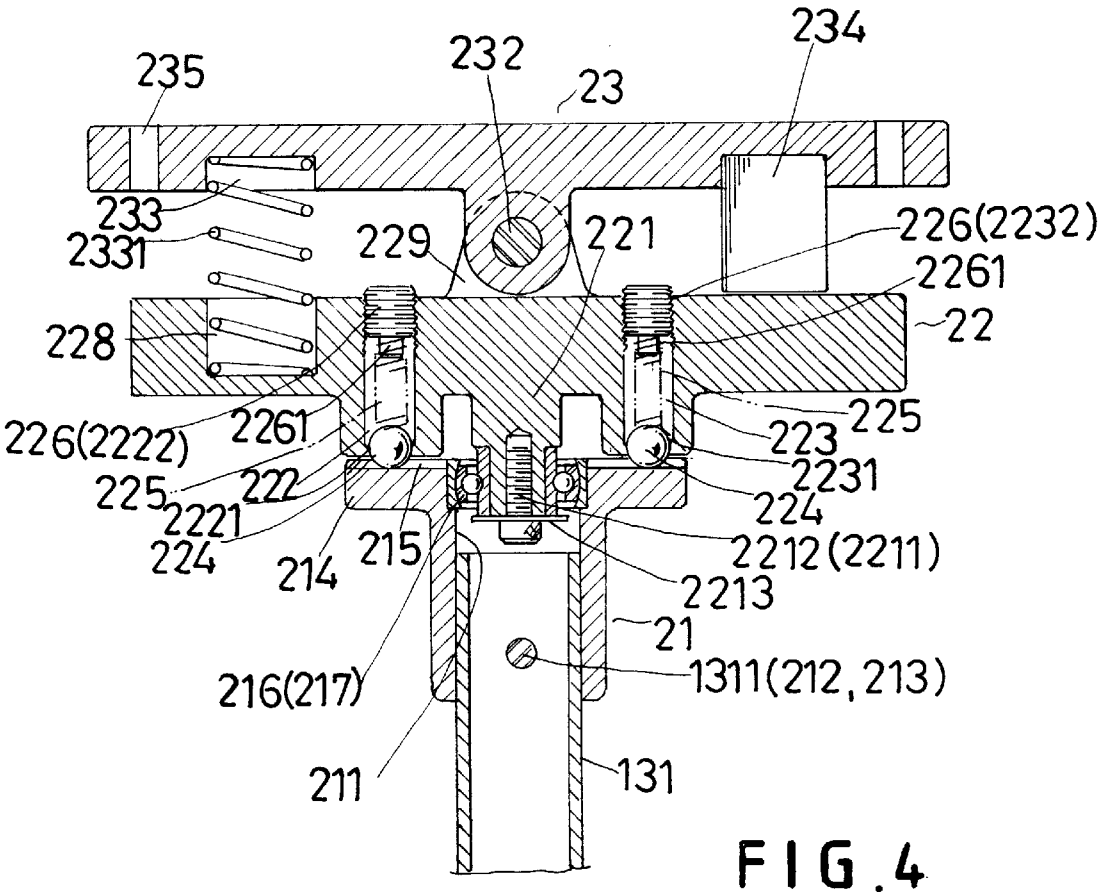
FIG. 4 is a cross-sectional view of an angle adjuster of the chair armrest adjuster of the present invention.

The angle adjuster 2, as shown in FIGS. 1, 4 and 5, includes a sleeve 21, a rotatable base 22 and a receptive base 23.

The sleeve 21 has a center hole 211 for the upper end of the upper tube portion 131 of the support tube 13 to fit in, and a pin hole 212 corresponding to the pin hole 1311 of the upper tube portion 131 for a pin 213 to fit through to keep the both 21 and 131 securely together. The sleeve 21 further has a flat position portion 214 formed on an upper side, and a plurality of semicircular grooves 215 arranged radially on the flat position portion, and a larger diameter portion 216 than the rest of the center hole 211 formed on an upper end for fitting a self-correcting bearing 217 therein.

The rotatable base 22 has a lower central shaft 221 to fit in a center hole of the self-correcting bearing 217, and the central shaft 221 has a center threaded hole 2211 for a screw 2212 with a washer 2213 to engage so as to fix the rotatable base 22 with the sleeve 21. Further, two opposite through holes 222, 223 are provided beside the central shaft 221, respectively having a small diameter portion 2221, 2231 and a threads portion 2222, 2232 for a steel bead 224 and a coil spring 225 to fit in the small diameter portion 2221, 2231 and for a headless screw 226 to engage the threads portion 2222, 2232. Then the steel bead 224 is pushed by the coil spring 225 to protrude a little out of the through hole 222, 223 to engage one of the semicircular circular grooves 215 of the sleeve 21. Further the coil spring 225 has its outer end resting on a stud 2261 of the screw 226 so as to rotate the screw 226 inward to press tightly the steel bead 224 against the flat position portion 214 of the sleeve 21. Further, an engage means 227 is provided to protrude down beside the through hole 223, having an functional portion 2271 to engage one of the semicircular grooves 215. Further, a hollow 228 opening upward is provided in an outer portion near the through hole 222, and the rotatable base 22 has an ear 229 with a lateral hole on a center portion for pivotally connecting with the receptive base 23.

The receptive base 23 has an ear 231 on a bottom center portion corresponding to the ear 229 of the rotatable base 22 for a pin 232 to pivotally connect the both 22, 23 together, and a recess 233 provided in a bottom surface of one side and a press block 234 provided in a bottom surface of the other side. The recess 233 is for an upper end of a coil spring 2331 to fit in, with a lower end of the spring 2331 fitting in and resting on the bottom of the hollow 228 of the rotatable base 22. The press block 234 has its lower end resting on an upper surface of the rotatable base 22 and its upper end bolstering the receptive base 23 for balancing the base 23 in a horizontal position. Further, the receptive base 23 has a through hole respectively in two ends for screws 236 to fix the receptive base 23 with a bottom side of the cushion 4 of the armrest.

In assembling, firstly the sleeve tube 11 of the vertical adjuster 1 is combined orderly with the locking tube 12, the support tube 13 and the locking means 14 with the linear bearings 1211, 1212 in the upper and the lower end of the sleeve tube 11 fixed in place with the stop plate 112 and the cap 123. The steel bead 143 in the through hole 142 of the locking means 14 extends out of the hole 1421 to fit just in the first guide slot 126 of the locking tube 12. Then the vertical portion 152 of the fix plate 15 is inserted in the insert groove 125 of the locking tube 12. Next, the sleeve 21 and the receptive base 23 of the angle adjuster 2 are respectively combined with the support tube 13 and the cushion 4 of the armrest, with the rotatable base 22 combined with the vertical adjuster 1 and the cushion 4 of the armrest.

If the armrest is wanted to be adjusted in its angle inward and outward, as shown in FIGS. 4 and 5, the cushion 4 of the armrest is pushed to incline to a certain angle and moved inward or outward, with the steel beads 224 in the through holes 222, 223 able to be moved to engage any one of the semicircular grooves 215 and kept with some force in the adjusted position.

Figure 8:
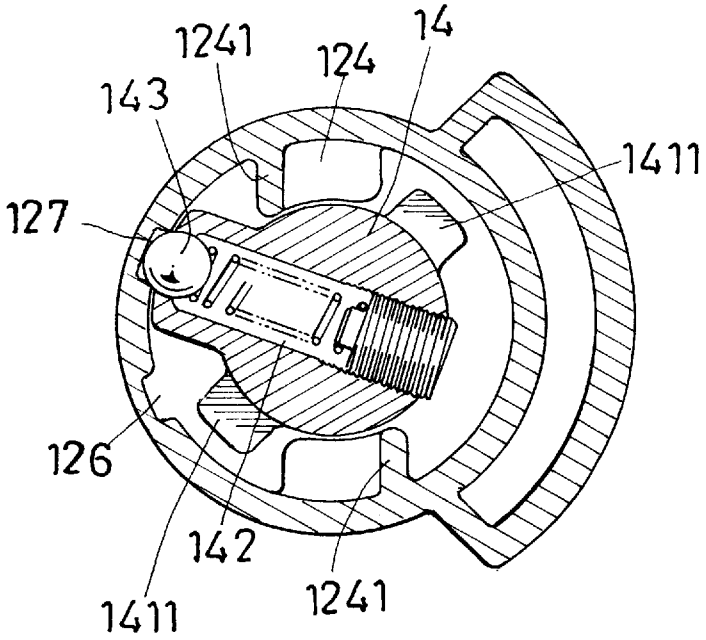
Figure 7:
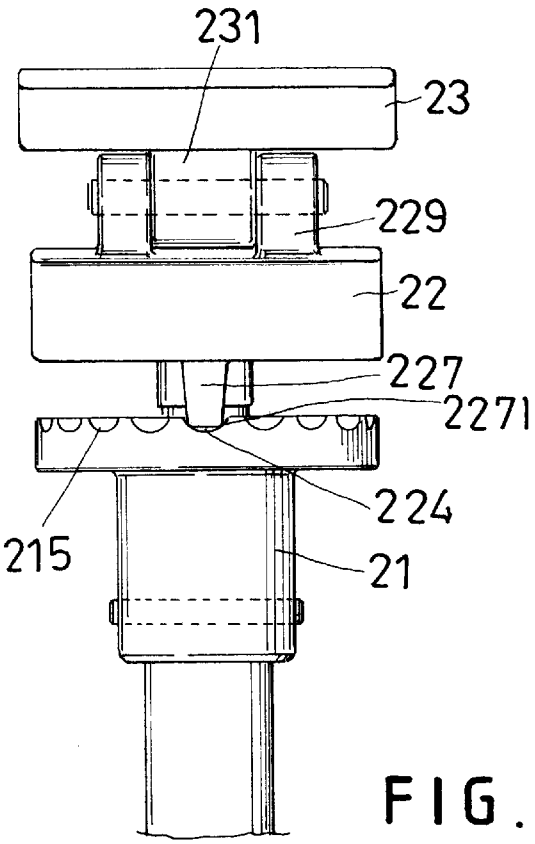
FIG. 7 is a front view of the angle adjuster of the chair armrest adjuster of the present invention, showing it being adjusted; and, FIG. 8 is an upper view of the angle adjuster of the chair armrest adjuster of the present invention, showing it being locked at an angle.
Figure 6:
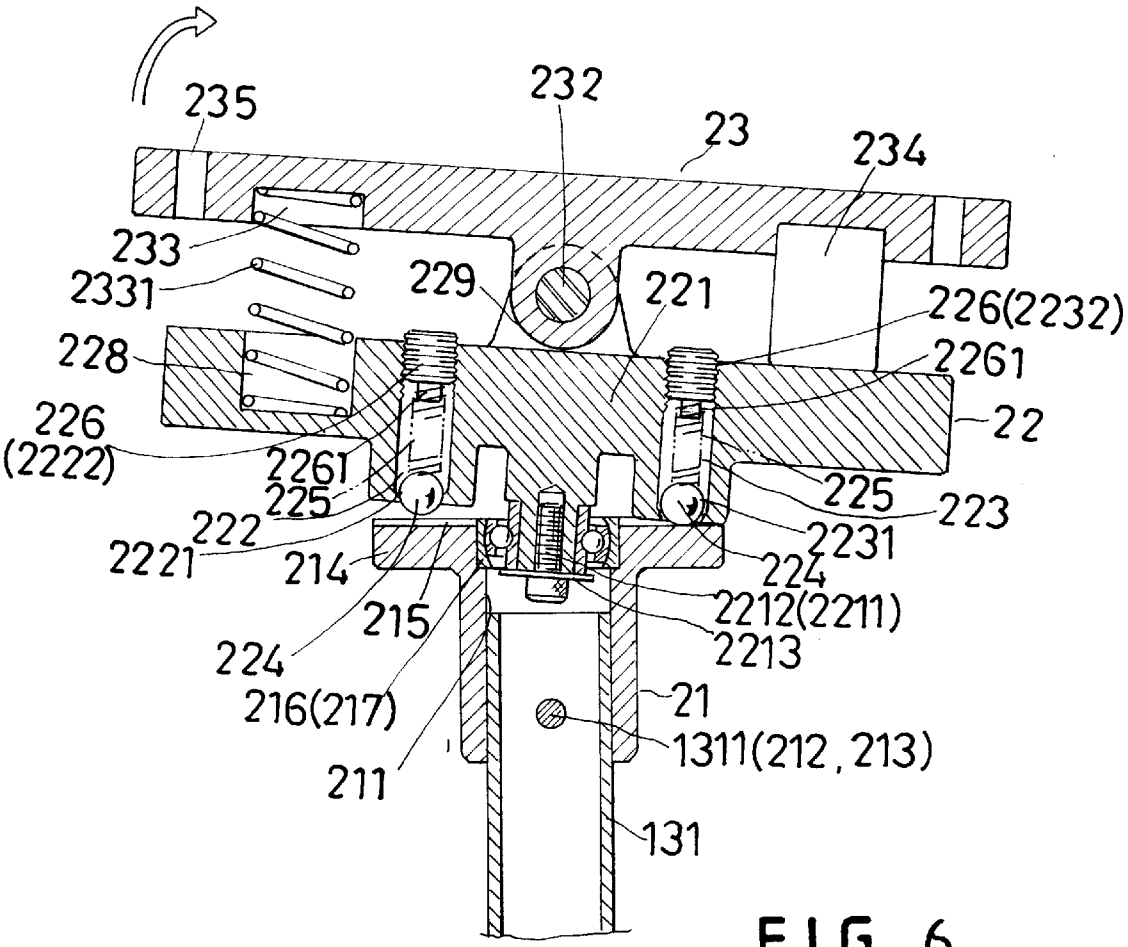
FIG. 6 is a side cross-sectional view of the angle adjuster of the chair armrest adjuster of the present invention, showing it being adjusted in one way.

If the height of the armrest is wanted to be adjusted, as shown in FIG. 6, the front end of the cushion 4 of the armrest is pulled up, forcing the rear side of the receptive base 23 pushing down with the ear 231 functioning as a pivot so that the rotatable base 22 may incline to a proper angle as the rotatable base 22 is kept in place with the lower shaft 1 fitting in the self-correcting bearing 217. At the same time, the steel beads 224 in the through holes 223 of the rotatable base 22 are pushed in the holes 223, forcing the functional portion 2271 of the engage means 227 fits and engages one of the semicircular grooves 215, as shown in FIG. 7. Then the cushion 4 is rotated to a certain angle, rotating the engage means 227 together with the rotatable base 22 and the sleeve 21 all at the same time, and rotating the upper tube portion 131 of the support tube 13 synchronously. Then, as shown in FIG. 8, when the locking studs 1411 of the locking means 14 in the support tube 13 separate from a pair of the opposite engage grooves 124, the steel bead 143 in the through hole 142 disengages from the first guide slot 126 and moves to engage the second guide slot 127. Therefore, the whole angle adjuster 2 only rotates in a limited scope by means of the short stop wall 1241 and the locking studs 1411. Thus, the cushion 4 may be automatically pushed up by the elasticity of the coil spring 111 in the sleeve tube 11 and the support tube 13, or the cushion 4 may be pressed down to force the coil spring 111 shrink down to a wanted height, and then rotated to the original position, letting the locking studs 1411 of the locking means 14 engage again one pair of the opposite engage grooves 124, securing the cushion 4 in the adjusted height.

As can be understood from the aforesaid description, the chair armrest adjuster in the invention has the following advantages.

1. The armrest of a chair can be adjusted in its height by the vertical adjuster and in its angle inward and outward by the angle adjuster, so a user can use the armrest locked at a comfortable position according to to the user's height, custom and need.
2. A user engaging in computer work can rest his arms on the armrest cushions, avoiding fatigue caused by raising the arms in typing.
3. The armrest cushion can be adjusted in the angle inward and outward, enabling arms of a user to rest comfortably on the cushions according to work necessity.

While the preferred embodiment of the invention has been described above, and it will be recognized and understood that various modifications may be made therein and the appended claims are intended to cover all such modifications which may fall within the spirit and scope of the invention.

What is claimed is:

1. A chair armrest adjuster comprising a vertical adjuster and an angle adjuster combined with a seat and an armrest cushion;

said vertical adjuster consisting of a sleeve tube, a locking tube, a support tube, a locking means and a fix plate;

said sleeve tube containing a coil spring of a proper length, having a stop plate formed on an upper end for connecting fixedly said locking tube;

said locking tube having its upper and lower end respectively combined with a linear bearing, a cap closing an upper open end and having a center hole, a plurality of pairs of two opposite engage grooves formed spaced apart equidistantly in an inner surface, each said engage groove having a short stop wall and an opening opposite to said short stop wall, a long insert groove formed in an outer surface for a vertical portion of said fix plate to fit therein, a first vertical guide slot and a second vertical guide slot respectively formed between two lines of said opposite engage grooves;

said locking means having a body provided with an engage stud respectively on two sides to engage one pair of said opposite engage grooves in said locking tube, said body further provided with a through hole having a small diameter portion on one side and a threads portion on the other side, a steel bead, a coil spring and a headless screw orderly fitted in said through hole, with said headless screw engaging said threads portion, connecting an upper tube portion and a lower tube portion;

said fix plate having a flat portion for said sleeve tube to rest thereon and a little sloping-down portion extending out from said flat portion fixed with a lower side of said seat, and said vertical portion fitting in said long insert groove of said locking tube;

said angle adjuster consisting of a sleeve, a rotatable base, and a receptive base;

said sleeve having a center hole for said upper tube portion of said support tube to fit fixedly therein, a flat plate portion formed in an upper end and provided with a plurality of semicircular grooves formed in in an upper surface, and a larger hole than said center hole formed in an upper end of said center hole for a self-correcting bearing to fit therein;

said rotatable base having a lower center shaft portion to fit in a hole of said self-correcting bearing of said sleeve and fixed with a screw and a washer with said sleeve, a through hole respectively bored at two sides of said lower shaft and having a small hole portion on one side and a threads portion on the other side, a steel bead, a coil spring and a headless screw orderly fitted in each said through hole, said headless screw engaging said threads portion of said through hole, said steel bead pushed by said coil spring to protrude a little out of said through hole to engage one of said semicircular grooves of said sleeve, one of said through hole having an engage means formed outside of said same hole, said engage means having an actional portion formed in a lower end to engage one of said semicircular grooves of said sleeve, a hollow opening upward provided at an outer side of one of said through holes, and an ear protruding from an upper surface for connecting pivotally with said receptive base:

said receptive base having its upper surface combined fixedly with said cushion, an ear on a bottom side to connect pivotally with said ear of said rotatble base, a recess formed on one side of said bottom, a press block fixed on the other side of said bottom, a coil spring having its upper end fitted in said recess and its lower end fitted in said hollow of said rotatable base, said press block having its lower end resting on an upper surface of said rotatable base to support said receptive base in a balanced position; and, said cushion able to be moved for a certain angle inward or outward, a front end of said cushion pulled up and swung to a proper angle to rotate said rotatable base, said upper tube portion of said support tube at the same time, forcing said locking studs of said locking means separate from one pair of said engage grooves, then said cushion moved up automatically by elasticity of said coil spring in said sleeve tube and said support tube, or said cushion pressed down by force to a needed height and locked at that height.

2. The chair armrest adjuster as claimed in claim 1, wherein said long insert groove of said locking tube and said vertical portion of said fix plate are shaped the same to fit with each other.

3. The chair armrest adjuster as claimed in claim 1, wherein said locking means of said vertical adjuster has its upper end connected with said upper tube portion and its lower end connected with said lower tube portion by means of pins and pin holes, and said lower tube portion has its lower end provided with a stud for securing said coil spring contained in said sleeve tube.

4. The chair armrest adjuster as claimed in claim 1, wherein said sleeve of said angle adjuster is combined fixedly with said support tube of said vertical adjuster by means of pins and pin holes.

5. The chair armrest adjuster as claimed in claim 1, wherein said semicircular grooves of said flat position portion are arranged radially.

* * * * *